US005120232A

United States Patent [19]

Korsunsky

[11] Patent Number: 5,120,232

[45] Date of Patent: Jun. 9, 1992

[54] ELECTRICAL CONNECTOR HAVING IMPROVED GROUNDING BUS BARS

[75] Inventor: Iosif Korsunsky, Harrisburg, Pa.

[73] Assignee: AMP Incorporated, Harrisburg, Pa.

[21] Appl. No.: 741,717

[22] Filed: Aug. 6, 1991

[51] Int. Cl.[5] ..... H01R 13/00

[52] U.S. Cl. ..... 439/108

[58] Field of Search ..... 439/79, 101, 108, 284, 439/290, 291

[56] References Cited

U.S. PATENT DOCUMENTS

| | | | |
|---|---|---|---|
| 3,072,340 | 1/1963 | Dean | 439/291 |
| 4,616,893 | 10/1986 | Feldman | 339/14 R |
| 4,695,106 | 9/1987 | Feldman et al. | 439/83 |
| 4,710,133 | 12/1987 | Lindeman | 439/92 |
| 4,762,500 | 8/1988 | Dola et al. | 439/79 |
| 4,907,979 | 3/1990 | Feldman | 439/83 |

FOREIGN PATENT DOCUMENTS

| | | | |
|---|---|---|---|
| 49-6543 | 2/1974 | Japan . | |
| 39197 | 3/1977 | Japan | 439/284 |

*Primary Examiner*—Gary F. Paumen

*Attorney, Agent, or Firm*—Bruce J. Wolstoncroft

[57] ABSTRACT

An electrical connector assembly has a first housing (16) and a second housing (18) with respective first and second bus bars (70, 170) provided therein. The bus bars (70, 170) are configured to be interwoven when the connector housings are mated together to ensure that the bus bars will occupy a minimal cross-sectional area. This allows the connector assembly to have terminals which are closely spaced, thereby minimizing the dimensions of the connector assembly.

10 Claims, 4 Drawing Sheets

ELECTRICAL CONNECTOR HAVING IMPROVED GROUNDING BUS BARS

FIELD OF THE INVENTION

The invention is directed to an electrical connector which is mounted on a printed circuit board. In particular the invention relates to an electrical connector which has a grounding bus which allows for close center-line spacing of the terminals.

BACKGROUND OF THE INVENTION

There are currently numerous electrical connectors available which are mounted to a printed circuit board. As the size of the machines in which the printed circuit boards are installed decreases, the density of the connectors positioned on the board must increase. Also, as the machines become more sophisticated, the complexity of the printed circuit boards and the connectors must increase. Consequently, the configuration of the machines requires that electrical connectors with numerous terminals extending therefrom be mounted on a printed circuit board in such a manner so as to occupy a minimal area of board real estate.

In order for the connectors to occupy a minimal amount of board real estate, it has become extremely desirable for connectors to have closely spaced terminals. To accomplish the required spacing, all dimensions of the connector must be minimized. However, the performance of the connector cannot be compromised due to the close centerline spacing of the terminals. It is therefore essential that the electrical characteristics of the connector not diminish as the size of the connector is reduced.

Consequently, in order to reduces the size of the connector which maintaining the electrical performance thereof, the present invention is directed to an enhanced grounding bus. The grounding bus requires minimal space, but provides the electrical characteristics to properly shield the closely spaced terminals of the connector.

SUMMARY OF THE INVENTION

The invention is directed to a bus bar assembly for use with an electrical connector. The bus bar assembly has a first bus bar member and a second bus bar member.

The first bus bar member has first portions and second portions. The second portions are laterally offset from the first portions. The second bus bar member has first mating portions and second mating portions. The second mating portions are offset from the first mating portions. The first portions of the first bus bar member are positioned in electrical and mechanical engagement with the second mating portions of the second bus bar member, and the second portions of the first bus bar member are positioned in electrical engagement with the first mating portions of the second bus bar member.

The invention is also directed to a connector assembly which has a first housing with first terminals provided therein and a second housing with second terminals provided therein. A first bus bar is secured to the first housing and has first portions and second portions which are offset from the first portions. The first and second portions are integrally attached by bights. A second bus bar is secured to the second housing, the second bus bar has first mating portions and second mating portions which are offset from the first mating portions. The first and second mating portions extend from and are integrally attached to a carrier portion. The first bus bar and the second bus bar are interwoven to provide the electrical characteristics required to provide sufficient grounding to the connector assembly.

DETAILED DESCRIPTION OF THE INVENTION

Figure 1:
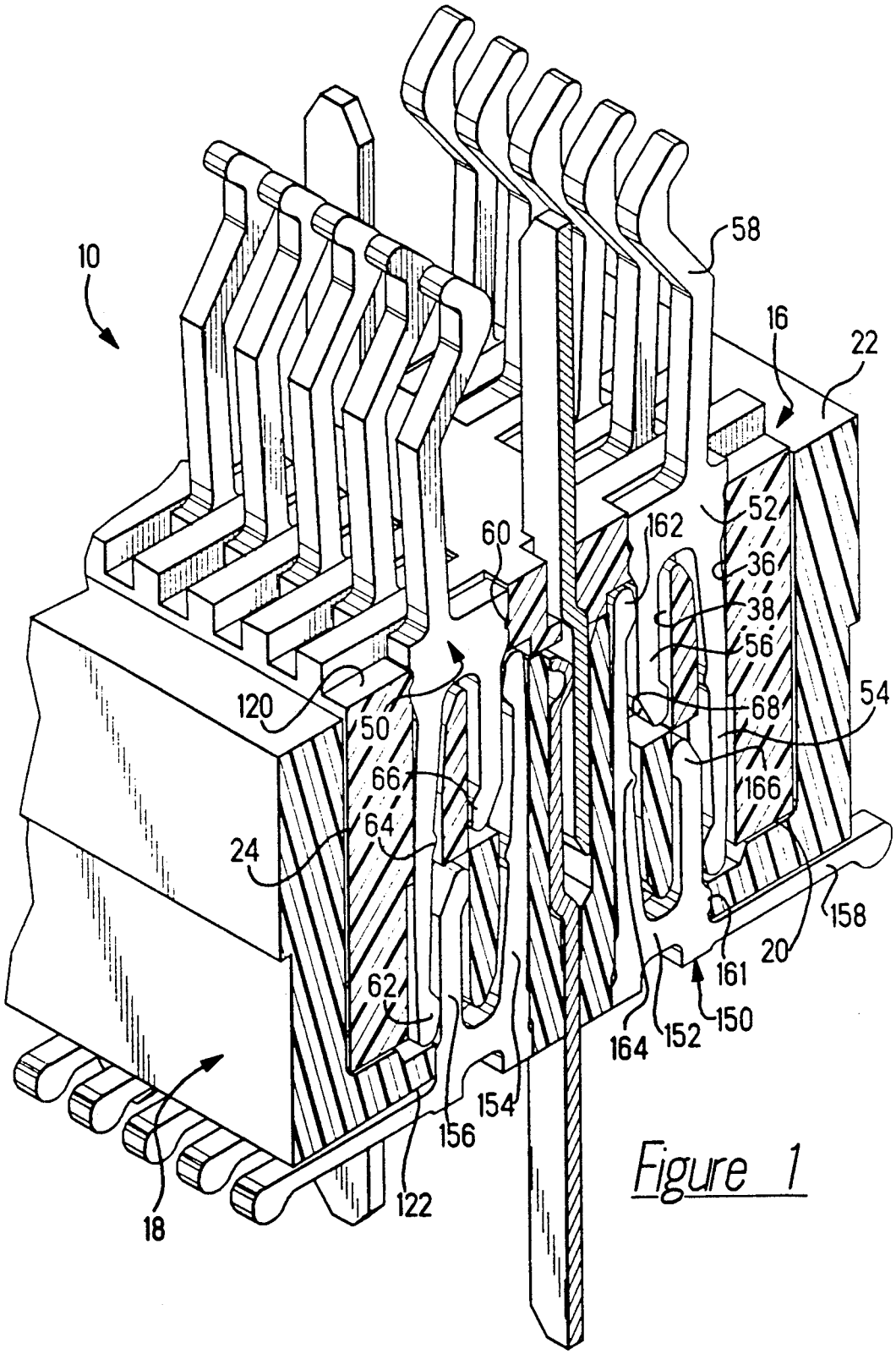
FIG. 1 is a three dimensional cross-sectional view of a connector assembly showing first and second connector housings in a mated condition.
Figure 2:
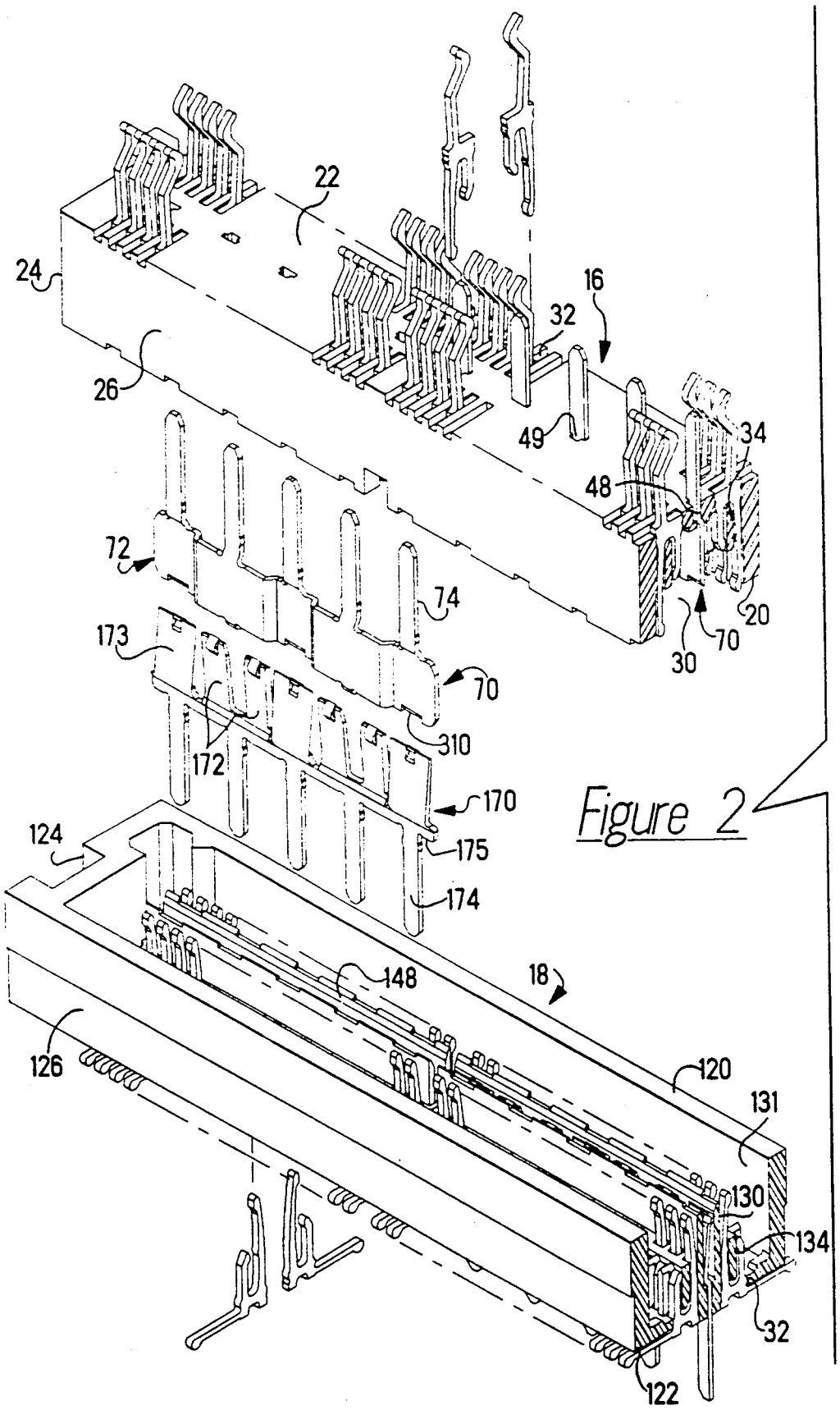
FIG. 2 is an exploded perspective view of the connector assembly of FIG. 1, showing a first connector housing and a second connector housing, with a bus bar provided therebetween.

Referring to FIG. 1, an electrical connector assembly 10 is shown which is used to provide the electrical connection between a first circuit board (not shown) and a second circuit board (not shown). The connector assembly 10 has a first connector housing 16 and a second connector housing 18, as best shown in FIG. 2.

The first connector housing 16 has a first or mating surface 20 and an oppositely facing second or terminal receiving surface 22. End walls 24 and side walls 26 extend between the mating surface 20 and the terminal receiving surface 22.

A mating connector receiving recess 30 extends from the mating surface 20 toward the terminal receiving surface 22. The mating connector receiving recess 30 is dimensioned to be positioned proximate the end walls 24 and proximate the side walls 26.

Terminal receiving cavities 32 are provided in the first connector housing !6 and extend from the terminal receiving surface 22 to the mating connector receiving recess 30. The terminal receiving cavities 32 are provided on both sides of the longitudinal axis of the first connector housing 16. The terminal receiving cavities 32 provided on a respective side of the axis are mirror images of the terminal receiving cavities provided on the opposite side of the axis. Referring to FIG. 2, dividing walls 34 are provided in the cavities, the dividing walls separate the terminal receiving cavities into two portions, first leg receiving cavities 36 and second leg receiving cavities 38.

Bus bar receiving recess 48, as best shown in FIGS. 2, is provided in the first connector housing 16. The bus bar receiving recess 48 extends from the mating connector receiving recess 30 to proximate the terminal receiving surface 22. Bus bar mating pin receiving recesses 49 extend from the recess 48 to the surface 22. The mating pin receiving recesses 49 are periodically spaced along the longitudinal axis of the housing 16.

First connector terminals 50, as best shown in FIG. 2, have mounting portions 52. First legs 54 and second legs 56 extend from the mounting portions 52 is essentially the same direction, thereby enabling the first and the second legs 54, 56 to be mated with the mating connector, as will be more fully discussed. Printed circuit board mating legs 58 extend from the mounting portions 52 in a direction which is opposed to the first and second legs 54, 56.

The mounting portions 52 have recesses 60 provided on side surfaces thereof. The recesses 60 cooperate with the securing projections 46 to provide the interference fit required to maintain the terminals 50 in the terminal receiving cavities 32. It should be noted that end surfaces of the dividing walls 34 also cooperate with surfaces of the mounting portions 52 to ensure that the terminals 50 are properly positioned.

First legs 54 have a slightly arcuate configuration. Free ends of the first legs have enlarged contact sections 62 which extend beyond the first leg receiving cavities 36 and into the mating connector receiving recess 30. Enlarged positioning sections 64 are also provided on the first legs 54. The positioning sections 64 cooperate with the dividing walls 34 when the first legs are in an unmated condition. It is important to note that the first leg receiving cavities 36 are dimensioned to allow the first legs 54 to move therein, thereby allowing the first legs to move from an unmated or slightly prestressed position to a mated position.

Figure 5:
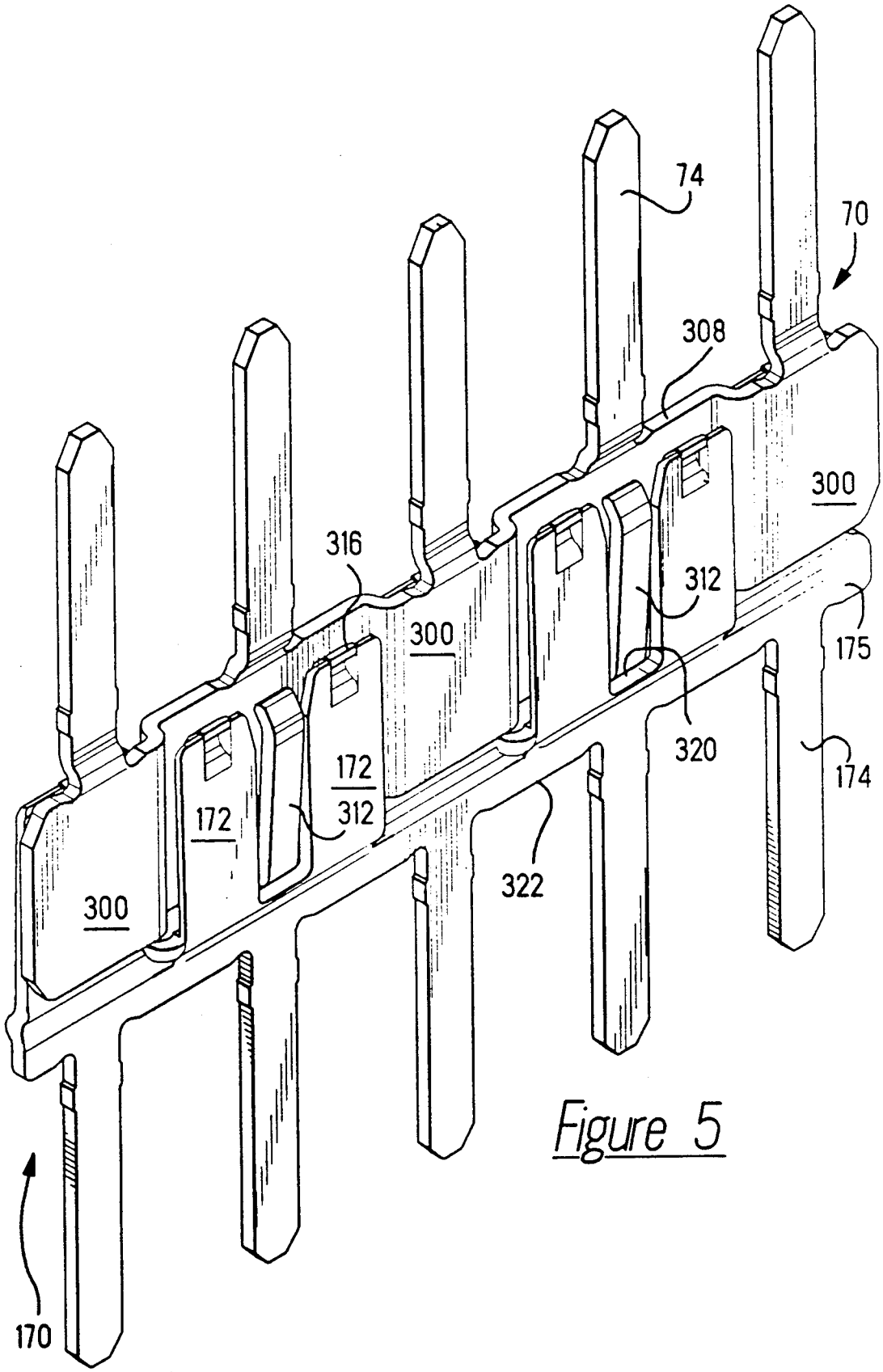
FIG. 5 is a perspective view of the first bus bar mated to the second bus bar, the housings are not shown to better illustrate the bus bars.

Second legs 56 are positioned in the second leg receiving cavities 38. Unlike the first legs, the second legs 56 do not extend into the mating connector receiving recess 30. Free ends 66 of the second legs are provided at an angle relative to the second legs. This allows the free ends 66 to engage the dividing walls 34, as shown in FIG. 5. Lead-in surfaces 68 are provided at the free ends 66 of the second legs 56.

Referring to FIGS. 2 and 5, bus bar 70 is positioned in the first connector housing 16 (as best shown in FIG. 2). The bus bar 70 has a connector mating portion 72 and circuit board mating pins 74. The circuit board mating pins 74, as shown in FIG. 2, are positioned in and extend through the mating pin receiving recesses 49. The connector mating portion extends from the bus bar receiving recess 48 into the mating connector receiving recess 30.

Figures 3, 4:
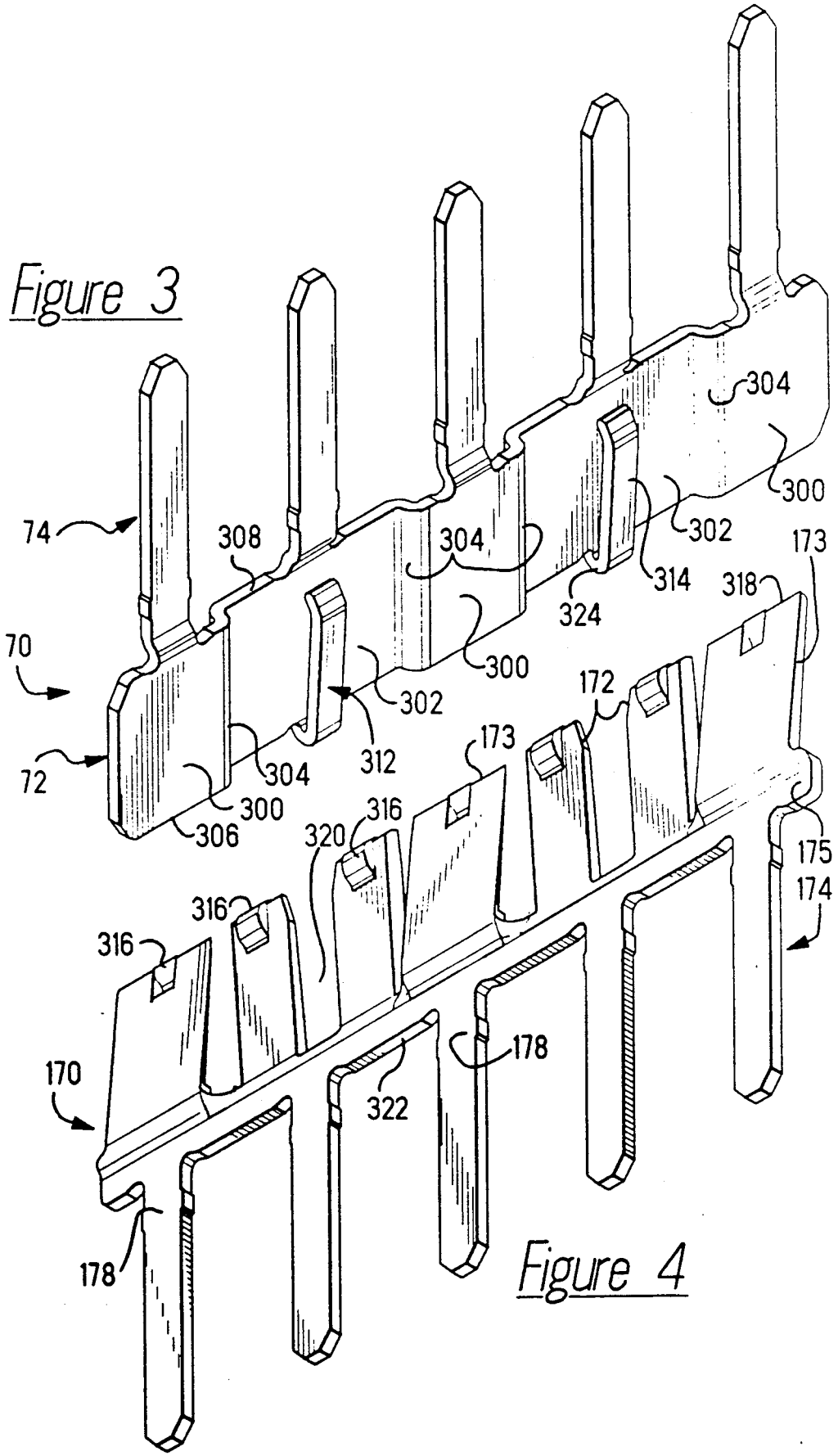
FIG. 3 is a perspective view of the first bus bar of the first connector housing.
FIG. 4 is a perspective view of the second bus bar of the second connector housing.

As best shown in FIG. 3, the connector mating portion 72 of the bus bar 70 has alternating first portions 300 and second portions 302. The first portions 300 are aligned in a first plane and the second portions 302 are aligned in a second plane. The second plane is essentially parallel to and laterally offset from the first plane. The first portions 300 are integrally attached to the second portions 302 by transition bights 304. The first portions 300 and the second portions 302 alternate along the length of bus bar 70 in a serpentine fashion. Bus bar 70 has a connector mating end 306 and a circuit board mating end 308. The first portions 300 have recesses 310 provided proximate the connector mating end 306. The recesses 310 act as lead-in surfaces when the connector housings are mated together.

The second portions 302 have mating arms 312 which extend from the connector mating end 306. As best shown in FIG. 3, the mating arms 312 are bent such that the free end portions 314 of the mating arms 312 are provided proximate the circuit board mating end 306. The free end portions 314 are positioned in the first plane, as described previously.

The circuit board mating pins 74 extend from the circuit board mating end 308 of first and second portions 300, 302. As shown in FIG. 3, the mating pins 74 are offset from the first and second portions 300, 302 and are positioned in a third plane which is parallel to and positioned between the first and second planes.

The second connector housing 18 is shown in FIGS. 1 and 2. Referring to FIG. 2, the second connector housing 18 has a first or mating surface 120 and an oppositely facing second or terminal receiving surface 122. A mating connector receiving recess 131 extends from the mating surface 120 toward the terminal receiving surface 122. End walls 124 and side walls 126 extend between the mating surface 120 and the terminal receiving surface 122 and define the recess 131.

A mating projection 130 extends into the connector receiving recess 131 away from the terminal receiving surface 122. The mating projection 130, as best shown in FIG. 2, is dimensioned to extend between the end walls 124.

Terminal receiving cavities 132 are provided in the second connector housing 18 and extend from the terminal receiving surface 122 toward the mating surface 120. As best shown in FIG. 2, the terminal receiving cavities 132 are provided on both sides of the longitudinal axis of the second connector housing 18. The terminal receiving cavities 132 provided on a respective side of the axis are mirror images of the terminal receiving cavities provided on the opposite side of the axis. The terminal receiving cavities 132 have dividing walls 134 which separate the terminal receiving cavities into two portions, first leg receiving cavities 136 and second leg receiving cavities 138.

Bus bar receiving recess !48, as best-shown in FIGS. 1 and 2, is provided in the second connector housing 18. The bus bar receiving recess 148 extends from the terminal receiving surface 122 toward the mating surface 120 through the mating projection 130.

Second connector terminals 150, as best shown in FIG. 2, have mounting portions 152. First legs 154 and second legs 156 extend from the mounting portions 152 is essentially the same direction, thereby enabling the first and the second legs 154, 156 to be mated with the mating connector, as will be more fully discussed. Printed circuit board mating legs 158 and stand off legs 159 extend from the mounting portions 152 in a direction which is opposed to the first and second legs 154, 156.

Terminals 150 have projections 161 which extend from side surfaces thereof. The projections 161 facilitate the interference fit of the terminals. It should be noted that end surfaces of the dividing walls 134 also cooperate with surfaces of the mounting portions 152 to ensure that the terminals 150 are properly positioned.

First legs 154 have a slightly arcuate configuration. Free ends of the first legs have enlarged contact sections 162 which extend beyond the first leg receiving cavities 136 into the recess 131. Enlarged positioning sections 164 are also provided on the first legs 154. The positioning sections 164 cooperate with the dividing walls 134 when the first legs are in an unmated condition. It is important to note that the first leg receiving cavities 136 are dimensioned to allow the first legs 154 to move therein, thereby allowing the first legs to move from an unmated or slightly prestressed position to a mated position.

Second legs 156 are positioned in the second leg receiving cavities 138. Free ends 166 of the second legs are provided at an angle relative to the second legs. This allows the free ends 166 to engage the dividing walls 134, as shown in FIG. 5. Lead-in surfaces 168 are provided at the free ends 166 of the second legs 156.

Referring to FIG. 4, bus bar 170 is positioned in the second connector housing 18. The bus bar 170 has alternating first connector mating portions 172 and second connector mating portions 173, and circuit board mating pins 174. First and second connector mating portions 172, 173 for cantilerered beams.

Bus bar 170 is stamped and formed from one continuous piece of material which has the appropriate electrical and mechanical characteristics. The distal ends of the first connector mating portions 172 are formed to be laterally offset from the longitudinal axis of the bus bar 170. The distal ends of the second connector mating portions 173 are formed to be laterally offset from the longitudinal axis of the bus bar 170 in the opposite directions of the first connector mating portions 172. The first connector mating portions 172 and the second connector mating portions 173 are separated from each other in parallel planes when the bus bar 170 is formed. However the portions 173 are integral with a carrier portion 175 to ensure that the bus bar 170 is maintained as one piece.

The first connector mating portions 172 and the second connector mating portions 173 have projections 316 which extend from the connector mating end 318 of the bus bar 170. The projections 316 extends from the portions 172, 173 toward the longitudinal axis of the bus bar 170 to cooperate with the bus bar 70 when connector housings 16, 18 are mated together. Slots 320 are provided on first connector mating portions 172 The slots 320 are dimensioned to receive the free end portions 314 of mating arms 312 therein.

The circuit board mating pins 174 extend from the circuit board mating end 322 in a direction away from the connector mating end 318. The circuit board mating pins 174 have enlarged securing projections 178 which cooperate with the second connector housing to maintain the bus bar 170 in the recess.

In operation, the first and second connector housings 16, 18 are mounted to respective circuit boards as is more fully described in copending U.S. patent application Ser. No. 07/692,084 filed April 26, 1991, which is hereby incorporated by reference. With the housings properly mounted, the connector housings are mated together, as shown in FIG. 1.

The first connector housing 16 is positioned proximate the second connector housing 18 such that the mating connector receiving recess 131 of the second housing is in alignment with the first connector housing. The mating connector receiving recess 30 is dimensioned to allow the first connector housing 16 to be inserted therein.

As the connector housings are moved to the assembled position shown in FIG. 1, the first connector terminals 50 engage the second connector terminals 150 to provide the electrical connection required.

As the mating occurs, the enlarged contact sections 62 of the first legs 54 of the first connector terminals 50 engage the lead-in surfaces 168 of the second legs 156 of the second connector terminals 150. At the same time, the enlarged contact sections 162 of the first legs 154 of the second connector terminals 150 engage the lead-in surfaces 68 of the second legs 56 of the first connector terminals 50.

The enlarged contact sections 62, 162 are then slide over the lead-in surfaces 168, 68, thereby positioning the enlarged contact sections 62, 162 on side surfaces of the second legs 156, 56. Several functions are performed by the lead-in surfaces. The lead-in surfaces compensate for any slight misalignment of the terminals when the mating occurs. The lead-in surfaces also cause the first legs 54, 154 to be moved to a stressed position, such that the enlarged contact sections 62, 162 will provide a significant normal force on the second legs 156, 56 when the contact sections are slide over the second legs.

As the mating of the connectors continues, the enlarged contact sections 62, 162 will be slid on the side surfaces of the second legs 156, 56 to the fully assembled position shown in FIG. 6. This sliding engagement of the enlarged contact sections provides a wiping action under significant normal force conditions, thereby helping to ensure for a positive electrical connection between the enlarged contact sections 62, 162 and the second legs 156, 56. It should be noted that as the enlarged contact sections 62, 162 of the first legs 54, 154 are slid over second legs 156, 56, walls of the housings prevent the first legs 54, 154 from taking a permanent set. In other words, the walls of the housings are provided in close proximity to the first legs 54, 154, thereby insuring that the first legs can not be deformed beyond their elastic limit.

As the connector housings are mated together, the bus bars 70, 170 are mated together, as best shown in FIG. 5. In the mated position the bus bar 70 is interwoven with bus bar 170. This interwoven configuration ensures that the bus bars 70, 170 will provide the electrical characteristics required. The bus bars 70, 170 are also configured to have a small cross-sectional width. This allows the bus bar to occupy a minimal area, thereby permitting close centerline spacing of the terminals.

In the mated condition the free ends 314 of the mating arms 312 are positioned in slots 320, thereby ensuring that the bus bar assembly 70, 170 is provided in close proximity to each terminal.

It should be noted that each bus bar is configured to have a narrow width. Consequently, it is important that a lead-in surface be provided to guide bus bar 70 into bus bar 170 when mating occurs. Without a lead-in surface the mating of the connectors would be hard to accomplish. As the connectors are mated together, the bends 324 of the mating arms 312 cooperate with the walls of bus bar receiving recess 138 and the bus bar 170 to properly position the bus bar 70 in the bus bar 170. The projections 316 of the bus bar 170 also cooperate with recesses 310 of the bus bar 70 to provide a guiding function. The projections 316 also are provided in electrical engagement with bus bar 70 when the bus bars 70, 170 are in the mated condition. This enhances the performance of the bus bars by ensuring that the bus bars provide the grounding required thereof.

Although the connector assembly described provides an pelectrical connection between two printed circuit boards, the principal of the invention can be utilized in other types of connector assemblies, i.e a cable to board connector assembly.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

I claim:

1. A connector assembly having a first housing with first terminals provided therein and a second housing with the second terminals provided therein, the connector assembly comprising:

a first bus bar secured to the first housing, the first bus bar has alternating first portions and second portions which are laterally offset from the first portions and thus life in parallel planes, the first and second portions are integrally attached to each other by bights, the resulting structure being serpentine;

a second bus bar secured to the second housing, the second bus bar has alternating first mating portions and second mating portions which are laterally offset from the first mating portions and thus have distal ends which lie in parallel planes, the first and second mating portions extend from and are integrally attached to a carrier portion and form resilient cantilevered beams.

whereby the first bus bar and the second bus bar are interwoven upon mating to provide the electrical characteristics required to provide sufficient grounding to the connector assembly.

2. A connector assembly as recited in claim 1 wherein the first portions of the first bus bar are aligned in a first plane, and the second portions are aligned in a second plane, the second plane is essentially parallel to and slightly offset from the first plane.

3. A connector assembly as recited in claim 2 wherein the first bus bar has a connector mating end and a circuit board mating end, recesses are provided in the first bus bar proximate the connector mating end, circuit board mating pins extend from the circuit board mating end in a direction away from the connector mating end, the circuit board mating pins extend through the first housing.

4. A connector assembly as recited in claim 3 wherein mating arms extend from a connector mating end of the first bus bar, the mating arms are bent such that free end portions of the mating arms are provided proximate a circuit board mating end of the first bus bar.

5. A connector assembly as recited in claim 4 wherein the mating arms extend from the second portions of the first bus bar, the free end portions of the mating arms are positioned in the first plane, in alignment with the first portions.

6. A connector assembly as recited in claim 5 wherein the first mating portions of the second bus bar have slots provided therein, the slots are dimensioned to receive respective mating arms of the first bus bar member therein.

7. A connector assembly as recited in claim 6 wherein the bent portion of the mating arms cooperates with the second bus bar to guide the first bus bar into engagement with the second bus bar.

8. A connector assembly as recited in claim 7 wherein the first mating portions of the second bus bar are offset from the longitudinal axis of the second bus bar, and the second mating portions are offset from the longitudinal axis in the opposite direction of the first mating portions.

9. A connector assembly as recited in claim 8 wherein the first mating portions and the second mating portions have projections which extend from the ends thereof, the projections extend from the portions toward the longitudinal axis of the second bus bar, thereby ensuring that projections will engage the first bus bar.

10. A connector assembly as recited in claim 9 wherein the projections of the second mating portions are positioned in alignment with the recesses of the first portions, the projections cooperate with the recesses to ensure that the first bus bar is properly positioned in the second bus bar.

* * * * *